US008326162B2

(12) United States Patent
DeJong et al.

(10) Patent No.: US 8,326,162 B2
(45) Date of Patent: Dec. 4, 2012

(54) BELT TRACKING USING TWO EDGE SENSORS

(75) Inventors: Joannes N. M. DeJong, Hopewell Junction, NY (US); Lloyd A. Williams, Mahopac, NY (US); Rudy Castillo, Briarwood, NY (US); Matthew Dondiego, West Milford, NJ (US)

(73) Assignee: Xerox Corporation, Norwalk, CT (US)

( * ) Notice: Subject to any disclaimer, the term of this patent is extended or adjusted under 35 U.S.C. 154(b) by 245 days.

(21) Appl. No.: 12/833,044

(22) Filed: Jul. 9, 2010

(65) Prior Publication Data

US 2012/0006215 A1 Jan. 12, 2012

(51) Int. Cl.
*G03G 15/00* (2006.01)
*G03G 15/16* (2006.01)

(52) U.S. Cl. ..... 399/36; 399/66; 399/302; 399/314; 399/315; 399/317

(58) Field of Classification Search ..... 399/162, 399/165, 302
See application file for complete search history.

(56) References Cited

U.S. PATENT DOCUMENTS

| | | | | |
|---|---|---|---|---|
| 5,510,877 | A * | 4/1996 | deJong et al. | 399/38 |
| 5,515,139 | A | 5/1996 | Hou et al. | |
| 5,519,230 | A | 5/1996 | Hubble, III et al. | |
| 5,565,965 | A | 10/1996 | Costanza et al. | |
| 6,594,460 | B1 | 7/2003 | Williams et al. | |
| 6,600,507 | B2 | 7/2003 | Sanchez et al. | |
| 6,721,528 | B1 * | 4/2004 | Schreieder et al. | 399/302 |
| 7,920,814 | B2 * | 4/2011 | Atwood et al. | 399/302 |
| 8,126,365 | B2 * | 2/2012 | Nishida et al. | 399/165 |
| 2002/0193191 | A1 | 12/2002 | Downing et al. | |
| 2003/0047424 | A1 | 3/2003 | Monahan et al. | |
| 2003/0063924 | A1 | 4/2003 | Burdick et al. | |
| 2003/0076405 | A1 | 4/2003 | Sanchez et al. | |
| 2003/0151775 | A1 | 8/2003 | Wang et al. | |
| 2005/0150747 | A1 | 7/2005 | Menedez et al. | |
| 2006/0289280 | A1 * | 12/2006 | Furuya et al. | 198/806 |
| 2009/0060215 | A1 * | 3/2009 | Ocasio | 381/67 |
| 2009/0090603 | A1 | 4/2009 | Ricciardi, Sr. et al. | |
| 2009/0297221 | A1 * | 12/2009 | Gross et al. | 399/165 |
| 2010/0189475 | A1 * | 7/2010 | Atwood et al. | 399/302 |

FOREIGN PATENT DOCUMENTS

JP 05238583 A * 9/1993

* cited by examiner

*Primary Examiner* — David Gray
*Assistant Examiner* — Francis Gray
(74) *Attorney, Agent, or Firm* — Gibb & Riley, LLC

(57) ABSTRACT

Methods and devices detect a first lateral measure of an edge of a belt loop supported by rollers within an apparatus using a first sensor to find an amount of misalignment of the edge of the belt loop relative to a known alignment position. The first sensor is positioned at a first location within the apparatus. The methods and devices also detect a second lateral measure of the edge of the belt loop within the apparatus relative to the known alignment position using a second sensor. The second sensor is positioned at a second location within the apparatus that is different than the first location. The methods and devices use a processor to determine the non-linear shape of the edge of the belt loop based on the second lateral measure of the edge of the belt loop detected by the second sensor. The methods and devices correct the amount of misalignment detected by the first sensor based on the non-linear shape of the edge of the belt loop to generate a corrected misalignment value, using the processor. Further, the method and devices adjust the current lateral position of the belt loop within the apparatus relative to the known alignment position based on the corrected misalignment value using a belt tracking actuator that is operatively connected to the processor.

20 Claims, 4 Drawing Sheets

BELT TRACKING USING TWO EDGE SENSORS

BACKGROUND

Embodiments herein generally relate to alignment of belt loops that are positioned around rollers within various devices, such as printers and, more particularly to an improved alignment method and apparatus that uses multiple sensors to account for non-uniformity in the shape of the edge of the belt.

Many belt loop systems with a longitudinally (process direction) moving belt use a servo control system with an actuator (for example a steering roll) and feedback from a belt edge sensor to control the lateral (cross process) position of the belt (edge). Most belts have edges that are not straight, e.g. they have a belt edge lateral variation (profile) as a function of longitudinally position along the belt. This belt edge profile has a basic periodicity of the length of the belt loop. The belt edge profile causes a point on the belt to not move in a straight line (tracking error). In imaging, print-making, or image transfer applications this leads to position errors of images that are generated at different process direction positions along the belt.

Some solutions include methods to create straight belt edges, but this requires a special set-up. Another solution uses a one-time set-up procedure to calibrate the edge profile. The belt is run for a few revolutions at a low tracking servo gain. In the absence of disturbances, the lower servo gain causes the belt to track better. The resulting belt edge profile is an approximation of the true edge profile only to the extent of how well the belt was tracking in the presence of disturbances during calibration.

SUMMARY

One method embodiment herein detects a first lateral measure of the edge of a belt loop supported by rollers within an apparatus using a first sensor to find an amount of misalignment of the edge of the belt loop relative to a known alignment position. The first sensor is positioned at a first location within the apparatus.

The method also detects a second lateral measure of the edge of the belt loop within the apparatus relative to the known alignment position using a second sensor. The second sensor is positioned at a second location within the apparatus that is different than the first location. The method uses a processor to determine a non-linear shape of the edge of the belt loop based on the second lateral measure of the edge of the belt loop detected by the second sensor.

The method corrects the amount of misalignment detected by the first sensor based on the non-linear shape of the edge of the belt loop to generate a corrected misalignment value, using the processor. Further, the method adjusts the current lateral position of the belt loop within the apparatus relative to the known alignment position based on the corrected misalignment value using a belt tracking actuator (e.g., steering roll, etc.) that is operatively connected to the processor.

When detecting the non-linear shape of the edge of the belt loop, the method senses lateral measures of many locations along the edge of the belt loop using the second sensor as the edge of the belt passes by the second sensor. The method then averages the lateral measures using the processor to produce an average lateral measure.

This allows the method to determine differences between the average lateral measure and location-specific lateral measures for each of the locations, using the processor. Then, the method stores the pattern of the differences between the average lateral measure and the location-specific lateral measures as the non-linear shape of the edge of the belt loop, using a computer-readable storage medium connected to the processor.

When correcting the amount of misalignment, the method subtracts each of the location-specific lateral measures from the amount of misalignment for each corresponding location along the edge of the belt loop as each corresponding location passes by the first sensor, using the processor. The method continually updates the non-linear shape as the edge of the belt loop moves by the second sensor, using the processor. Further, this process of adjusting the current lateral position of the belt loop within the apparatus, can be performed for variable speed or constant speed belts.

One apparatus embodiment herein comprises at least one set of rollers and a belt loop that contacts and is supported by the rollers. A first sensor is positioned at a first location adjacent the belt loop. The first sensor detects a first lateral measure of the edge of the belt loop to find an amount of misalignment of the edge of the belt loop relative to a known alignment position. A second sensor is positioned at a second location adjacent the belt loop that is different than the first location. The second sensor detects a second lateral measure of the edge of the belt loop relative to the known alignment position.

A processor is operatively connected to the first sensor and the second sensor. The processor determines a non-linear shape of the edge of the belt loop based on the second lateral measure of the edge of the belt loop detected by the second sensor. The processor also corrects the amount of misalignment detected by the first sensor based on the non-linear shape of the edge of the belt loop to generate a corrected misalignment value.

One of the rollers is a belt tracking actuator and is operatively connected to the processor and contacts the belt loop, the belt tracking actuator adjusts a current lateral position of the belt loop relative to the known alignment position based on the corrected misalignment value.

When detecting the non-linear shape of the edge of the belt loop, the processor senses lateral measures of many locations along the edge of the belt loop (using the second sensor) as the edge of the belt passes by the second sensor. The processor then averages the lateral measures to produce an average lateral measure. Then, the processor determines the differences between the average lateral measure and location-specific lateral measures for each of the locations and stores the pattern of the differences between the average lateral measure and the location-specific lateral measures as the non-linear shape of the edge of the belt loop (using a computer-readable storage medium connected to the processor).

When correcting the amount of misalignment, the processor subtracts each of the location-specific lateral measures from the amount of misalignment for each corresponding location along the edge of the belt loop as each corresponding location passes by the first sensor. The processor continually updates the non-linear shape as the edge of the belt loop moves by the second sensor. Further, the belt loop can comprise either a variable speed or constant speed belt loop.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, the belt edge profile causes a point on the belt to not move in a straight line (tracking error). The embodiments herein provide a device and a method in a belt tracking servo control system that use edge sensors in first and second locations along the belt.

Figure 1:
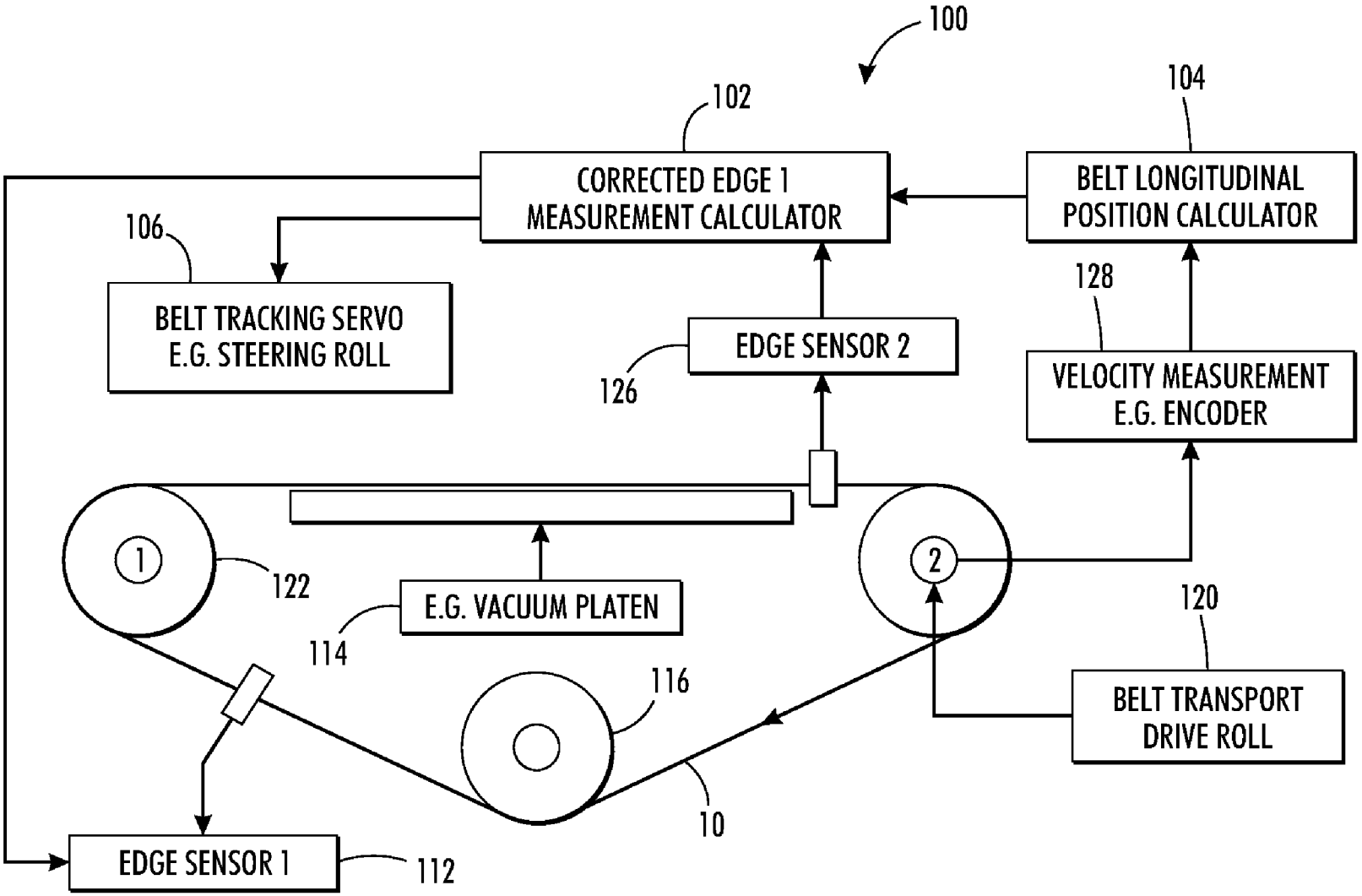
FIG. 1 is a side-view schematic diagram of a device according to embodiments herein.

More specifically, as shown in FIG. 1, a belt 10 is driven over one or more support rolls (sometimes referred to as rollers herein) 116 and a belt tracking actuator, such as a steering roll 122 by a drive roll 120. As is well-known by those ordinarily skilled in the art, the belt 102 can be used to transport items, such as sheets of media. The items that are transported using the belt 102 can be moved to (or by) devices, such as imaging stations (that could, for example, generate c,m,y,k image separations of a color image in an electrostatic, ink jet or other imaging devices).

The embodiments herein include a first belt edge sensor 112, that is mounted to a frame of the device 100. The first belt edge sensor 112 measures a belt edge position at a first longitudinal position along the belt 10 that is a summation of contributions from the following phenomena: belt tracking error (the deviation from a straight line of a point on the belt 10); actuator induced belt edge displacement (an example is a steering roll angle change introducing a belt edge displacement); and belt edge profile (non-straightness of the belt edge).

A tracking control system that uses a single belt edge measurement will introduce a belt tracking error (deviation of a point on the belt 10 from a straight line) due to the existence of the belt edge profile. In image generation system, this will cause belt lateral positional errors (registration errors) resulting in image artifacts. Hence it is desirable to reduce or eliminate the effect of such belt edge profile noise.

To this end, the embodiments herein use two edge sensors 112 and 126 to measure the belt edge position in two locations. The distance between the two sensors 112 and 126 along the belt loop 10. The second sensor 126 is used to measure an approximate belt edge profile. This second sensor 126 is mounted in a location that minimizes actuator induced belt edge displacement as explained above (e.g. at a position relatively away from the steering roll 122). This will improve the accuracy of the belt edge profile measurement. The first sensor 112 is used to obtain a belt edge measurement as the feedback signal for the tracking control system 106.

The second edge sensor 126 measures the value of the belt edge profile at a second longitudinal position along the belt 10. This value of the edge profile is subtracted from the first measurement when the belt 10 position arrives at the first location by the corrected measurement calculator 102. This yields a corrected first edge measurement that is used as the feedback signal in the servo control 106. This method converges, that is, in a few belt 10 revolutions the effect of the belt edge profile is significantly reduced and continues to improve with each revolution. Excellent belt tracking is thus achieved by embodiments herein with associated improvement in registration.

The belt loop 100 can be made of photoreceptor material, intermediate material, plastic or other material. The belt loop 10 loop 10 can, for example, transport a sheet of paper or other material. The sheet may be in intimate contact with the web or belt loop 10 loop 10 through vacuum 114, electrostatic forces, gripper bars or other methods. Further, the transport media velocity is measured using, for example, a rotary encoder 128 attached to a roll or laser Doppler surface measurement.

The transport media drive system 120 can include, for example, a DC motor, an AC motor, a stepper motor, a hydrostatic drive or other actuator, as well as an optional gear, belt or other transmission. The drive system 120 can also use a power amplifier that provides actuation power for the actuator through amplification (and sometimes conversion) of the low power control signal. The drive system 120 can have a conventional servo controller which controls velocity of the transport media by means of outputting a control signal to the power amplifier to drive the motor.

The belt edge sensors 112 and 126 mentioned above can comprise any form of sensor and can be, for example optical sensors, sensors described in U.S. Pat. Nos. 5,519,230 and 5,565,965 (the complete disclosure of which is incorporated herein by reference); or any other sensors that use a physical phenomena to measure an edge position. Further, conventional systems are available to provide belt tracking control based on feedback. For example, see U.S. Pat. No. 6,594,460 entitled "Low force lateral photoreceptor or intermediate transfer belt tracking correction system" and similar methods and systems described in U.S. Pat. Nos. 6,600,507 and 5,515,139, all of which are fully incorporated herein by reference.

Thus, the first sensor 112 is positioned at a first location adjacent the belt loop 10. The first sensor 112 detects a first lateral measure of the edge of the belt loop 10 to find an amount of misalignment of the edge of the belt loop 10 relative to a known alignment position. The second sensor 126 is positioned at a second location adjacent the belt loop 10 that is different than the first location. The second sensor 126 detects a second lateral measure of the edge of the belt loop 10 relative to the known alignment position.

A processor 102 is operatively connected to the first sensor 112 and the second sensor 126. The processor 102 determines the non-linear shape of the edge of the belt loop 10 based on the second lateral measure of the edge of the belt loop 10 detected by the second sensor 126.

When detecting the non-linear shape of the edge of the belt loop 10, a second processor 104 senses lateral measures of many locations along the edge of the belt loop 10 (using the second sensor 126) as the edge of the belt 10 passes by the second sensor 126. Note that the first and second processors could be combined into a single processor, depending upon implementation.

The processor 104 averages the lateral measures from the second sensor 126 to produce an average lateral measure. Then, the processor 104 determines the differences between the average lateral measure and location-specific lateral measures for each of the locations and stores the pattern of the differences between the average lateral measure and the location-specific lateral measures as the non-linear shape of the edge of the belt loop 10 (using a computer-readable storage medium connected to or within the processor 104).

The processor 102 corrects the amount of misalignment detected by the first sensor 112 based on the non-linear shape of the edge of the belt loop 10 to generate a corrected misalignment value. When correcting the amount of misalignment, the processor 102 subtracts each of the location-specific lateral measures from the amount of misalignment for each corresponding location along the edge of the belt loop 10 as each corresponding location passes by the first sensor 112.

The belt tracking actuator 122 is operatively connected to the processor 102 and contacts the belt loop 10. The belt tracking actuator adjusts the current lateral position of the belt loop 10 relative to the known alignment position based on the corrected misalignment value. The processor 102 continually updates the non-linear shape as the edge of the belt loop 10 moves by the second sensor 126. The belt loop 10 can comprise either a variable speed or constant speed belt loop 10, as discussed in greater detail below.

In one embodiment herein, the belt 10 travels at a constant known velocity V as, for instance, in case of a stepper motor drive. The time interval that it takes for a point on the belt 10 to travel from sensor location 1 (122) to sensor location 2 (108) is T12=D/V. Also, the time it takes for the belt 10 to complete one revolution is Trev=L/V, where L is the length of the belt loop 10.

Then, a computer, processor, or belt longitudinal position calculator 104 and corrected edge measurement calculator 102 record measurements Y2 (t) from the second sensor 126. The measurements are saved over an interval (t-T12, t), where t is the current time. In sampled data systems with a sampling period Ts, the values Y2 can be stored, for example, in a circular buffer of size T12/TS (rounded up to the nearest integer) or any other computer-readable storage medium or storage device (located within either calculator 102, 104.

Every revolution of the belt 10 an offset value Y2off is saved by the belt longitudinal position calculator 104. If a belt seam detection sensor (Belt Hole Sensor) is available, it will give a signal once every belt revolution. This signal can be used as the time to save an offset value Y2off. This embodiment uses the last stored value Y2off. This value can be found from by either: every Trev seconds, a single value of Y2 (t) denoted Y2off is saved by the belt longitudinal position calculator 104; or Y2off is calculated and stored as the average of Y2 (t) over one belt revolution by the belt longitudinal position calculator 104. The belt edge position Y1 (t) is then measured with sensor 1. This embodiment then calculates a corrected belt edge position as Y1CORR=Y1 (t)−Y2 (t-T12)−Y2off using the corrected edge measurement calculator 102. This allows Y1CORR to be used as the feedback signal for the tracking controller 106.

In another embodiment, the belt 10 can travel at varying velocities V (t) as, for instance, measured by an encoder. In the embodiment, the belt longitudinal position calculator 104 calculates the belt 10 longitudinal position X (t) as the integral of the belt velocity V (t) over time. The belt longitudinal position calculator 104 collects the measurement Y2 (t) of second sensor 126 and the associated belt 10 position, X (t). This yields a belt edge position that can be formulated as a function of belt longitudinal position, i.e Y2(x). The measurements are saved over an interval of the sensor spacing D.

In this embodiment, every revolution of the belt 10, an offset value Y2off is saved by the belt longitudinal position calculator 104. This embodiment also uses the last stored value Y2off. This value is obtained by either: every revolution a single value of Y2(x), denoted Y2off is saved; or Y2off is calculated and stored as the average of Y2(x) over one belt 10 revolution.

This embodiment then measures the belt edge position Y1(x) with sensor 112. A corrected belt edge position is calculated by the corrected edge measurement calculator 102 as Y1CORR=Y1(x)−Y2(x-D)−Y2off. This embodiment uses Y1CORR as the feedback signal for the tracking controller 106. While the value Y2(x-L) may not be exactly available, nearest neighbor or interpolation schemes can be used to fetch a suitable value.

The first embodiment (constant velocity) can be considered a special case of the second embodiment (varying velocity). With embodiments herein, the sensor measurements may be averaged over a certain interval (temporal or spatial). This increases signal to noise ratio and decreases the size of the storage buffer.

Figure 2:
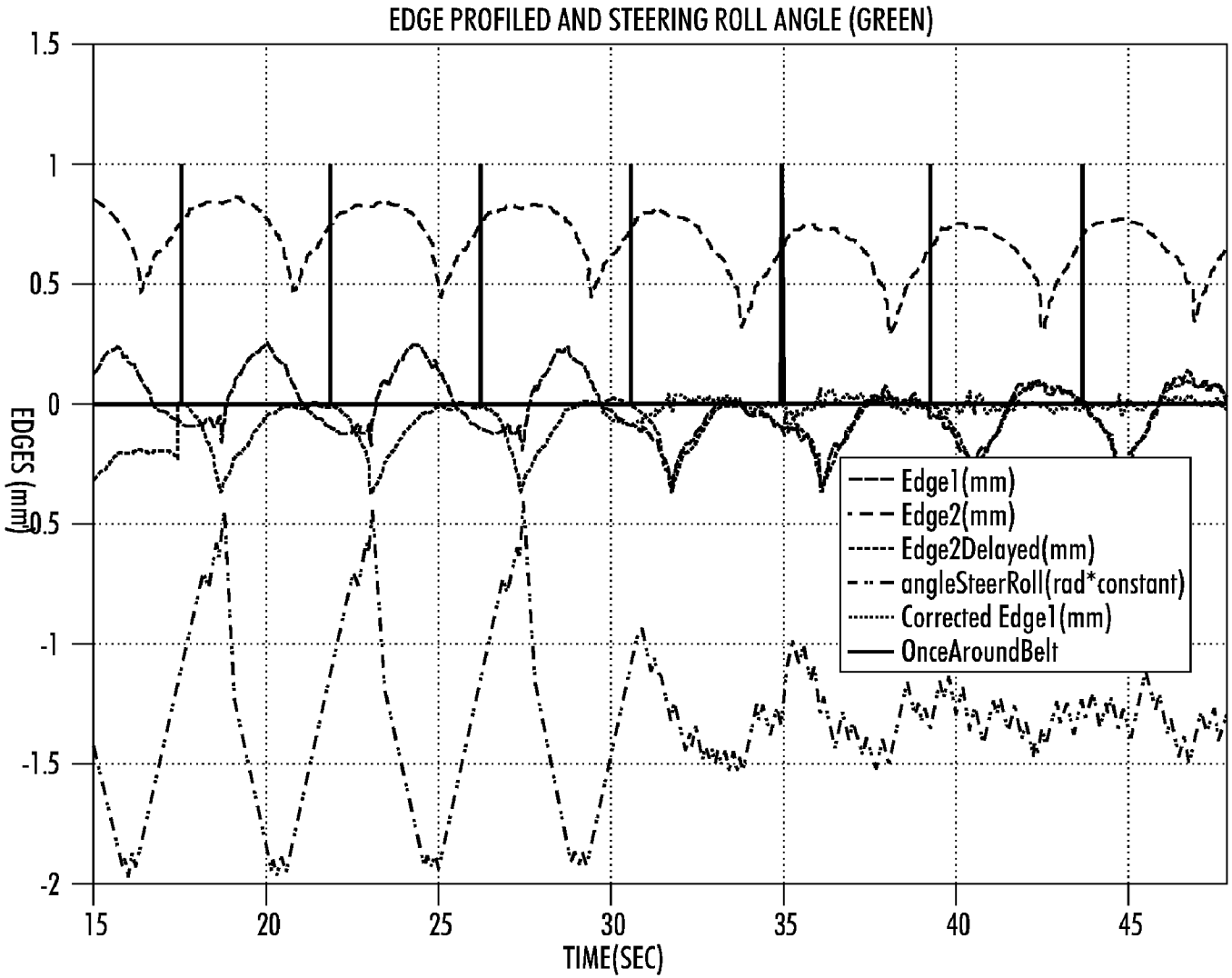
FIG. 2 is a graph showing the effects of embodiments herein.

FIG. 2 shows the tracking performance using a constant velocity embodiment. In FIG. 2, the first part of the figure (time<29 seconds) shows conventional tracking control. The signal from sensor 2 (126) is shown as the top line, is denoted as edge2 in the legend, and approximates the belt edge profile. The feedback from sensor 1 (112) is shown as the second line from the top, and is denoted as edge1 in the legend. The signals from sensor1 and sensor 2 are not identical due to the edge motion that is induced by the steering roll 122. The third line from the top is the delayed edge2 signal, the delay being an amount that is equal to the travel time of the belt from second sensor 126 to first sensor 112. The bottom line in FIG. 2 is proportional to the steering roll 122 angle. In conventional tracking control this angle varies a great deal and causes unwanted tracking error.

In the second part of FIG. 2, the embodiments herein were applied. In FIG. 2, the corrected edge1 signal after 29 seconds is clearly distinguished from the same signal in the first 29 seconds. After the embodiments herein are applied (after 29 seconds) the variations in angle of the steering roll are greatly reduced, leading to improved tracking performance and improved image quality (i.e. registration).

Figure 3:
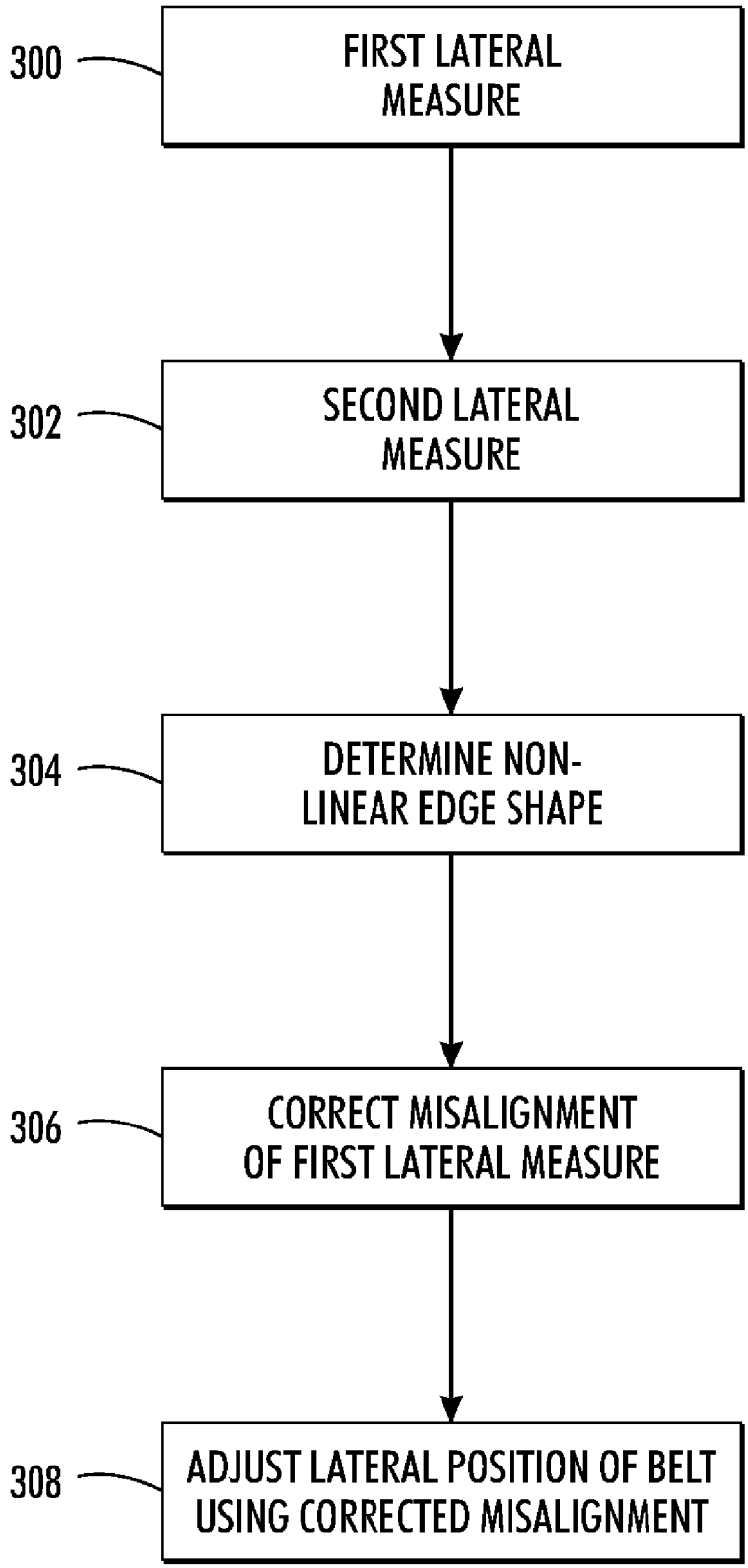
FIG. 3 is a flow diagram according to embodiments herein.

Therefore, as shown in flowchart form in FIG. 3, the embodiments herein provide methods and devices that detect a first lateral measure of the edge of a belt loop supported by rollers within an apparatus using a first sensor to find a total or gross amount of misalignment of the edge of the belt loop relative to a known alignment position in item 300. The first sensor is positioned at a first location within the apparatus.

The method also detects a second lateral measure of the edge of the belt loop within the apparatus relative to the known alignment position using a second sensor in item 302. The second sensor is positioned at a second location within the apparatus that is different than the first location. The method uses a processor to determine a non-linear shape of the edge of the belt loop based on the second lateral measure of the edge of the belt loop detected by the second sensor in item 304.

When detecting the non-linear shape of the edge of the belt loop in item 304, the method senses lateral measures of many locations along the edge of the belt loop using the second sensor as the edge of the belt passes by the second sensor. The method then averages the lateral measures using the processor to produce an average lateral measure in item 304. This allows the method to determine differences between the average lateral measure and location-specific lateral measures for each of the locations, using the processor. Then, the method stores the pattern of the differences between the average lateral measure and the location-specific lateral measures as the non-linear shape of the edge of the belt loop, using a computer-readable storage medium connected to the processor in item 304.

The method then corrects the total amount of misalignment detected by the first sensor based on the non-linear shape of the edge of the belt loop to generate a corrected (net) misalignment value, using the processor in item 306. When correcting the amount of misalignment in item 306, the method subtracts each of the location-specific lateral measures from the amount of misalignment for each corresponding location along the edge of the belt loop as each corresponding location passes by the first sensor, using the processor.

Further, the method adjusts the current lateral position of the belt loop within the apparatus relative to the known alignment position based on the corrected misalignment value using a belt tracking actuator that is operatively connected to the processor in item 308. The method continually updates the non-linear shape as the edge of the belt loop moves by the second sensor, using the processor. Further, this process of adjusting the current lateral position of the belt loop within the apparatus, can be performed for variable speed or constant speed belts.

Embodiments provide accurate tracking control due to the improved method and system that learn the belt edge shape. Further, the method and system continuously update the belt edge shape. With embodiments herein, no separate calibration routine is needed. Conventional calibration routines performed as part of an initial set-up procedure only provide an approximate belt edge profile. With the systems and methods herein there is rapid convergence within only a few belt revolutions.

The methods and systems herein do not need a belt hole sensor to provide a once per belt revolution signal, thereby savings the cost of the belt hole sensor and avoiding the weakening of the belt that can sometimes accompany belt holes.

Figure 4:
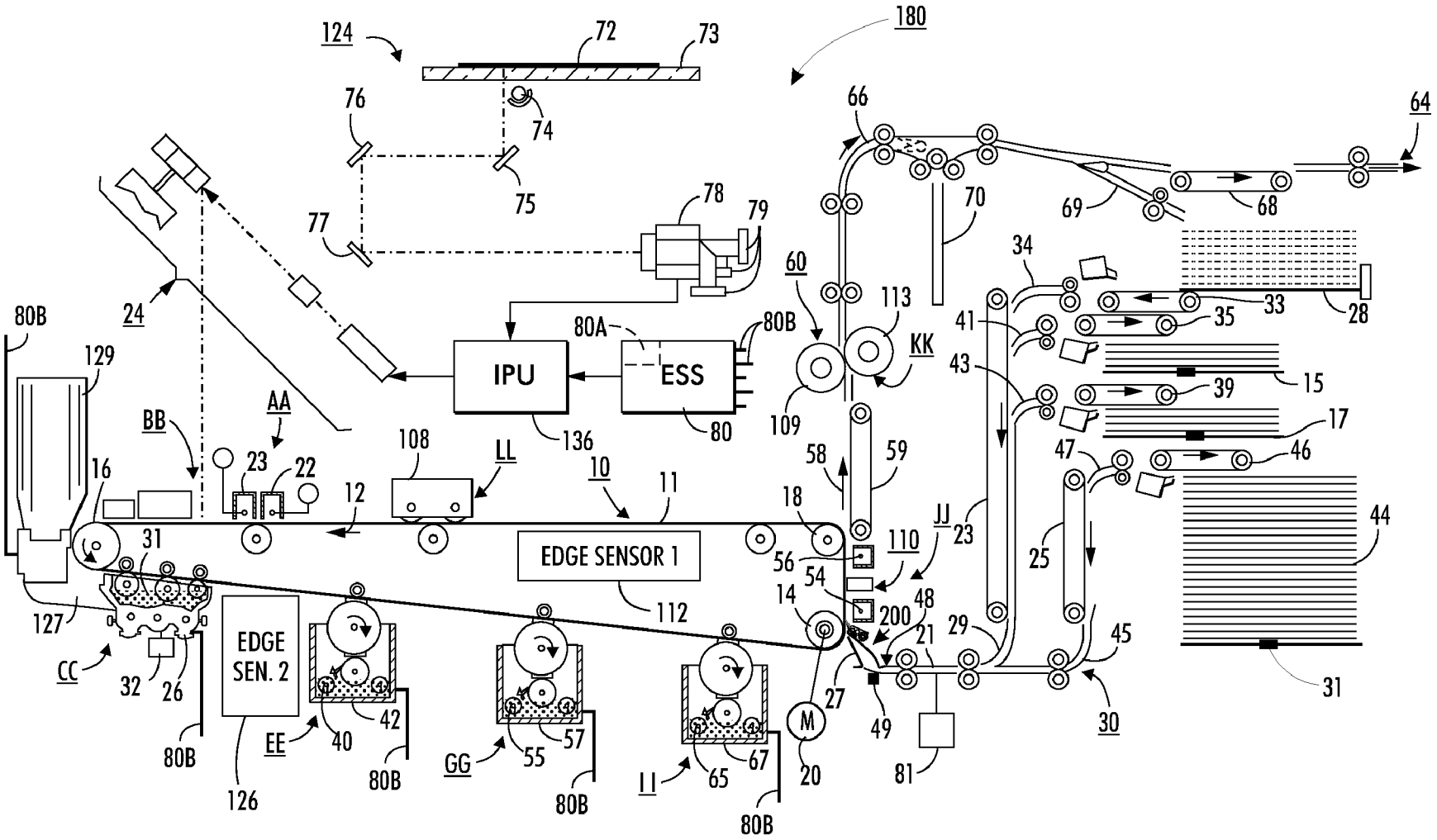
FIG. 4 is a side-view schematic diagram of a device according to embodiments herein.

With respect to a multi-function printing device embodiment, more specifically, FIG. 4 illustrates an exemplary electrostatic reproduction machine, for example, a multipass color electrostatic reproduction machine 180. As is well known, the color copy process typically involves a computer generated color image which may be conveyed to an image processor 136, or alternatively a color document 72 which may be placed on the surface of a transparent platen 73. A scanning assembly 124, having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where the information is read. Each CCD 79 outputs a digital image signal the level of which is proportional to the intensity of the incident light. The digital signals represent each pixel and are indicative of blue, green, and red densities. They are conveyed to the IPU 136 where they are converted into color separations and bit maps, typically representing yellow, cyan, magenta, and black. IPU 136 stores the bit maps for further instructions from an electronic subsystem (ESS).

The ESS is preferably a self-contained, dedicated minicomputer having a central processor unit (CPU), computer readable storage medium (memory), and a display or graphic user interface (GUI) 83. The ESS is the control system which, with the help of sensors 614, and connections 80B as well as a pixel counter 80A, reads, captures, prepares and manages the image data flow between IPU 136 and image input terminal 124. Note that in FIG. 7, not all wiring and connections are illustrated to avoid clutter. In addition, the ESS 80 is the main multi-tasking processor for operating and controlling all of the other machine subsystems and printing operations. These printing operations include imaging, development, sheet delivery and transfer, and particularly control of the sequential transfer assist blade assembly. Such operations also include various functions associated with subsequent finishing processes. Some or all of these subsystems may have micro-controllers that communicate with the ESS 80.

The multipass color electrostatic reproduction machine 180 employs a photoreceptor 10 in the form of a belt having a photoconductive surface layer 11 on an electroconductive substrate. The surface 11 can be made from an organic photoconductive material, although numerous photoconductive surfaces and conductive substrates may be employed. The belt 10 is driven by means of motor 20 having an encoder attached thereto (not shown) to generate a machine timing clock. Photoreceptor 10 moves along a path defined by rollers 14, 18, and 16 in a counter-clockwise direction as shown by arrow 12.

Initially, in a first imaging pass, the photoreceptor 10 passes through charging station AA where a corona generating devices, indicated generally by the reference numeral 22, 23, on the first pass, charge photoreceptor 10 to a relatively high, substantially uniform potential. Next, in this first imaging pass, the charged portion of photoreceptor 10 is advanced through an imaging station BB. At imaging station BB, the uniformly charged belt 10 is exposed to the scanning device 24 forming a latent image by causing the photoreceptor to be discharged in accordance with one of the color separations and bit map outputs from the scanning device 24, for example black. The scanning device 24 is a laser Raster Output Scanner (ROS). The ROS creates the first color separatism image in a series of parallel scan lines having a certain resolution, generally referred to as lines per inch. Scanning device 24 may include a laser with rotating polygon minor blocks and a suitable modulator, or in lieu thereof, a light emitting diode array (LED) write bar positioned adjacent the photoreceptor 10.

At a first development station CC, a non-interactive development unit, indicated generally by the reference numeral 26, advances developer material 31 containing carrier particles and charged toner particles at a desired and controlled concentration into contact with a donor roll, and the donor roll then advances charged toner particles into contact with the latent image and any latent target marks. Development unit 26 may have a plurality of magnetic brush and donor roller members, plus rotating augers or other means for mixing toner and developer. These donor roller members transport negatively charged black toner particles for example, to the latent image for development thereof which tones the particular (first) color separation image areas and leaves other areas untoned. Power supply 32 electrically biases development unit 26. Development or application of the charged toner particles as above typically depletes the level and hence concentration of toner particles, at some rate, from developer material in the development unit 26. This is also true of the other development units (to be described below) of the machine 180.

On the second and subsequent passes of the multipass machine 180, the pair of corona devices 22 and 23 are employed for recharging and adjusting the voltage level of both the toned (from the previous imaging pass), and untoned areas on photoreceptor 10 to a substantially uniform level. A power supply is coupled to each of the electrodes of corona recharge devices 22 and 23. Recharging devices 22 and 23 substantially eliminate any voltage difference between toned areas and bare untoned areas, as well as to reduce the level of residual charge remaining on the previously toned areas, so that subsequent development of different color separation toner images is effected across a uniform development field.

Imaging device 24 is then used on the second and subsequent passes of the multipass machine 180, to superimpose subsequent a latent image of a particular color separation image, by selectively discharging the recharged photoreceptor 10. The operation of imaging device 24 is of course controlled by the controller, ESS 80. One skilled in the art will recognize that those areas developed or previously toned with black toner particles will not be subjected to sufficient light from the imaging device 24 as to discharge the photoreceptor region lying below such black toner particles. However, this is of no concern as there is little likelihood of a need to deposit other colors over the black regions or toned areas.

Thus on a second pass, imaging device 24 records a second electrostatic latent image on recharged photoreceptor 10. Of the four development units, only the second development unit 42, disposed at a second developer station EE, has its development function turned "on" (and the rest turned "off") for developing or toning this second latent image. As shown, the second development unit 42 contains negatively charged developer material 40, for example, one including yellow toner. The toner 40 contained in the development unit 42 is thus transported by a donor roll to the second latent image recorded on the photoreceptor 10, thus forming additional toned areas of the particular color separation on the photoreceptor 10. A power supply (not shown) electrically biases the development unit 42 to develop this second latent image with the negatively charged yellow toner particles 40. As will be further appreciated by those skilled in the art, the yellow colorant is deposited immediately subsequent to the black so that further colors that are additive to yellow, and interact therewith to produce the available color gamut, can be exposed through the yellow toner layer.

On the third pass of the multipass machine 180, the pair of corona recharge devices 22 and 23 are again employed for recharging and readjusting the voltage level of both the toned and untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas, as well as to reduce the level of residual charge remaining on the previously toned areas so that subsequent development of different color toner images is effected across a uniform development field. A third latent image is then again recorded on photoreceptor 10 by imaging device 24. With the development functions of the other development units turned "off", this image is developed in the same manner as above using a third color toner 55 contained in a development unit 57 disposed at a third developer station GG. An example of a suitable third color toner is magenta. Suitable electrical biasing of the development unit 57 is provided by a power supply, not shown.

On the fourth pass of the multipass machine 180, the pair of corona recharge devices 22 and 23 again recharge and adjust the voltage level of both the previously toned and yet untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas as well as to reduce the level of residual charge remaining on the previously toned areas. A fourth latent image is then again created using imaging device 24. The fourth latent image is formed on both bare areas and previously toned areas of photoreceptor 10 that are to be developed with the fourth color image. This image is developed in the same manner as above using, for example, a cyan color toner 65 contained in development unit 67 at a fourth developer station II. Suitable electrical biasing of the development unit 67 is provided by a power supply, not shown.

Following the black development unit 26, development units 42, 57, and 67 are preferably of the type known in the art which do not interact, or are only marginally interactive with previously developed images. For examples, a DC jumping development system, a powder cloud development system, or a sparse, non-contacting magnetic brush development system are each suitable for use in an image on image color development system as described herein. In order to condition the toner for effective transfer to a substrate, a negative pretransfer corotron member negatively charges all toner particles to the required negative polarity to ensure proper subsequent transfer.

Since the machine 180 is a multicolor, multipass machine as described above, only one of the plurality of development units, 26, 42, 57 and 67 may have its development function turned "on" and operating during any one of the required number of passes, for a particular color separation image development. The remaining development units thus have their development functions turned off.

During the exposure and development of the last color separation image, for example by the fourth development unit 65, 67 a sheet of support material is advanced to a transfer station JJ by a sheet feeding apparatus 30. During simplex operation (single sided copy), a blank sheet may be fed from tray 15 or tray 17, or a high capacity tray 44 could thereunder, to a registration transport 21, in communication with controller 81, where the sheet is registered in the process and lateral directions, and for skew position. As shown, the tray 44 and each of the other sheet supply sources includes a sheet size sensor 31 that is connected to the controller 80. One skilled in the art will realize that trays 15, 17, and 44 each hold a different sheet type.

The speed of the sheet is adjusted at registration transport 21 so that the sheet arrives at transfer station JJ in synchronization with the composite multicolor image on the surface of photoconductive belt 10. Registration transport 21 receives a sheet from either a vertical transport 23 or a high capacity tray transport 25 and moves the received sheet to pretransfer baffles 27. The vertical transport 23 receives the sheet from either tray 15 or tray 17, or the single-sided copy from duplex tray 28, and guides it to the registration transport 21 via a turn baffle 29. Sheet feeders 35 and 39 respectively advance a copy sheet from trays 15 and 17 to the vertical transport 23 by chutes 41 and 43. The high capacity tray transport 25 receives the sheet from tray 44 and guides it to the registration transport 21 via a lower baffle 45. A sheet feeder 46 advances copy sheets from tray 44 to transport 25 by a chute 47.

As shown, pretransfer baffles 27 guide the sheet from the registration transport 21 to transfer station JJ. Charge can be placed on the baffles from either the movement of the sheet through the baffles or by the corona generating devices 54, 56 located at marking station or transfer station JJ. Charge limiter 49 located on pretransfer baffles 27 and 48 restricts the amount of electrostatic charge a sheet can place on the baffles 27 thereby reducing image quality problems and shock hazards. The charge can be placed on the baffles from either the movement of the sheet through the baffles or by the corona generating devices 54, 56 located at transfer station JJ. When the charge exceeds a threshold limit, charge limiter 49 discharges the excess to ground.

Transfer station JJ includes a transfer corona device 54 which provides positive ions to the backside of the copy sheet. This attracts the negatively charged toner powder images from photoreceptor belt 10 to the sheet. A detack corona device 56 is provided for facilitating stripping of the sheet from belt 10. A sheet-to-image registration detector 110 is located in the gap between the transfer and corona devices 54 and 56 to sense variations in actual sheet to image registration and provides signals indicative thereof to ESS 80 and controller 81 while the sheet is still tacked to photoreceptor belt 10.

The transfer station JJ also includes the transfer assist blade assembly 200. After transfer, the sheet continues to move, in the direction of arrow 58, onto a conveyor 59 that advances the sheet to fusing station KK.

Fusing station KK includes a fuser assembly, indicated generally by the reference numeral 60, which permanently fixes the transferred color image to the copy sheet. Preferably, fuser assembly 60 comprises a heated fuser roller 109 and a backup or pressure roller 113. The copy sheet passes between fuser roller 109 and backup roller 113 with the toner powder image contacting fuser roller 109. In this manner, the multicolor toner powder image is permanently fixed to the sheet. After fusing, chute 66 guides the advancing sheet to feeder 68 for exit to a finishing module (not shown) via output 64. However, for duplex operation, the sheet is reversed in position at inverter 70 and transported to duplex tray 28 via chute 69. Duplex tray 28 temporarily collects the sheet whereby sheet feeder 33 then advances it to the vertical transport 23 via chute 34. The sheet fed from duplex tray 28 receives an image on the second side thereof, at transfer station JJ, in the same manner as the image was deposited on the first side thereof. The completed duplex copy exits to the finishing module (not shown) via output 64.

After the sheet of support material is separated from photoreceptor 10, the residual toner carried on the photoreceptor surface is removed therefrom. The toner is removed for example at cleaning station LL using a cleaning brush structure contained in a unit 108.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A method comprising:

detecting a first lateral measure of an edge of a belt loop supported by rollers within an apparatus using a first sensor positioned at a first location within said apparatus to find an amount of misalignment of said edge of said belt loop relative to a known alignment position;

detecting a second lateral measure of said edge of said belt loop within said apparatus relative to said known alignment position using a second sensor positioned at a second location within said apparatus that is different than said first location;

determining a non-linear shape of said edge of said belt loop using a processor operatively connected to said first sensor and said second sensor based on said second lateral measure of said edge of said belt loop detected by said second sensor;

correcting said amount of misalignment detected by said first sensor based on said non-linear shape of said edge of said belt loop to generate a corrected misalignment value using said processor; and adjusting a current lateral position of said belt loop within said apparatus relative to said known alignment position based on said corrected misalignment value using a belt tracking actuator operatively connected to said processor.

2. The method according to claim 1, said detecting of said non-linear shape of said edge of said belt loop comprising:

sensing lateral measures of a plurality of locations along said edge of said belt loop using said second sensor as said edge of said belt passes by said second sensor;

averaging said lateral measures using said processor to produce an average lateral measure;

determining differences between said average lateral measure and location-specific lateral measures for each of said locations using said processor; and storing a pattern of said differences between said average lateral measure and said location-specific lateral measures as said non-linear shape of said edge of said belt loop using a non-transitory computer-readable storage medium connected to said processor.

3. The method according to claim 2, said correcting of said amount of misalignment comprising subtracting each of said location-specific lateral measures from said amount of misalignment for each corresponding location along said edge of said belt loop as each said corresponding location passes by said first sensor, using said processor.

4. The method according to claim 1, further comprising continually updating said non-linear shape as said edge of said belt loop moves by said second sensor using said processor.

5. The method according to claim 1, said adjusting of said current lateral position of said belt loop within said apparatus being performed for variable speed and constant speed belts.

6. A method comprising:

detecting a first lateral measure of an edge of a sheet transport belt supported by rollers within an printing apparatus using a first sensor positioned at a first location within said printing apparatus to find an amount of misalignment of said edge of said sheet transport belt relative to a known alignment position;

detecting a second lateral measure of said edge of said sheet transport belt within said printing apparatus relative to said known alignment position using a second sensor positioned at a second location within said printing apparatus that is different than said first location;

determining a non-linear shape of said edge of said sheet transport belt using a processor operatively connected to said first sensor and said second sensor based on said second lateral measure of said edge of said sheet transport belt detected by said second sensor;

correcting said amount of misalignment detected by said first sensor based on said non-linear shape of said edge of said sheet transport belt to generate a corrected misalignment value using said processor; and adjusting a current lateral position of said sheet transport belt within said printing apparatus relative to said known alignment position based on said corrected misalignment value using a belt tracking actuator operatively connected to said processor.

7. The method according to claim 6, said detecting of said non-linear shape of said edge of said sheet transport belt comprising:

sensing lateral measures of a plurality of locations along said edge of said sheet transport belt using said second sensor as said edge of said sheet transport passes by said second sensor;

averaging said lateral measures using said processor to produce an average lateral measure;

determining differences between said average lateral measure and location-specific lateral measures for each of said locations using said processor; and storing a pattern of said differences between said average lateral measure and said location-specific lateral measures as said non-linear shape of said edge of said sheet transport belt using a non-transitory computer-readable storage medium connected to said processor.

8. The method according to claim 7, said correcting of said amount of misalignment comprising subtracting each of said location-specific lateral measures from said amount of misalignment for each corresponding location along said edge of said sheet transport belt as each said corresponding location passes by said first sensor, using said processor.

9. The method according to claim 6, further comprising continually updating said non-linear shape as said edge of said sheet transport belt moves by said second sensor using said processor.

10. The method according to claim 6, said adjusting of said current lateral position of said sheet transport belt within said printing apparatus being performed for variable speed and constant speed sheet transports.

11. An apparatus comprising:

at least one set of rollers;

a belt loop contacting and being supported by said rollers;

a first sensor positioned at a first location adjacent said belt loop, said first sensor detecting a first lateral measure of an edge of said belt loop to find an amount of misalignment of said edge of said belt loop relative to a known alignment position;

a second sensor positioned at a second location adjacent said belt loop that is different than said first location, said second sensor detecting a second lateral measure of said edge of said belt loop relative to said known alignment position; and a processor operatively connected to said first sensor and said second sensor, said processor determining a non-linear shape of said edge of said belt loop based on said second lateral measure of said edge of said belt loop detected by said second sensor, said processor correcting said amount of misalignment detected by said first sensor based on said non-linear shape of said edge of said belt loop to generate a corrected misalignment value, one of said rollers comprising a belt tracking actuator operatively connected to said processor, said belt tracking actuator adjusting a current lateral position of said belt loop relative to said known alignment position based on said corrected misalignment value.

12. The apparatus according to claim 11, said processor detecting said non-linear shape of said edge of said belt loop by:

sensing lateral measures of a plurality of locations along said edge of said belt loop using said second sensor as said edge of said belt passes by said second sensor;

averaging said lateral measures using said processor to produce an average lateral measure;

determining differences between said average lateral measure and location-specific lateral measures for each of said locations using said processor; and storing a pattern of said differences between said average lateral measure and said location-specific lateral measures as said non-linear shape of said edge of said belt loop using a non-transitory computer-readable storage medium connected to said processor.

13. The apparatus according to claim 12, said processor correcting said amount of misalignment by subtracting each of said location-specific lateral measures from said amount of misalignment for each corresponding location along said edge of said belt loop as each said corresponding location passes by said first sensor.

14. The apparatus according to claim 11, said processor continually updating said non-linear shape as said edge of said belt loop moves by said second sensor.

15. The apparatus according to claim 11, said belt loop comprising one of a variable speed and constant speed belt loop.

16. A printing apparatus comprising:

at least one set of rollers;

a sheet transport belt contacting and being supported by said rollers;

a first sensor positioned at a first location adjacent said sheet transport belt, said first sensor detecting a first lateral measure of an edge of said sheet transport belt to find an amount of misalignment of said edge of said sheet transport belt relative to a known alignment position;

a second sensor positioned at a second location adjacent said sheet transport belt that is different than said first location, said second sensor detecting a second lateral measure of said edge of said sheet transport belt relative to said known alignment position; and a processor operatively connected to said first sensor and said second sensor, said processor determining a non-linear shape of said edge of said sheet transport belt based on said second lateral measure of said edge of said sheet transport belt detected by said second sensor, said processor correcting said amount of misalignment detected by said first sensor based on said non-linear shape of said edge of said sheet transport belt to generate a corrected misalignment value, one of said rollers comprising a belt tracking actuator operatively connected to said processor, said belt tracking actuator adjusting a current lateral position of said sheet transport belt relative to said known alignment position based on said corrected misalignment value.

17. The printing apparatus according to claim 16, said processor detecting said non-linear shape of said edge of said sheet transport belt by:

sensing lateral measures of a plurality of locations along said edge of said sheet transport belt using said second sensor as said edge of said belt passes by said second sensor;

averaging said lateral measures using said processor to produce an average lateral measure;

determining differences between said average lateral measure and location-specific lateral measures for each of said locations using said processor; and storing a pattern of said differences between said average lateral measure and said location-specific lateral measures as said non-linear shape of said edge of said sheet transport belt using a non-transitory computer-readable storage medium connected to said processor.

18. The printing apparatus according to claim 17, said processor correcting said amount of misalignment by subtracting each of said location-specific lateral measures from said amount of misalignment for each corresponding location along said edge of said sheet transport belt as each said corresponding location passes by said first sensor, using said processor.

19. The printing apparatus according to claim 16, said processor continually updating said non-linear shape as said edge of said sheet transport belt moves by said second sensor.

20. The printing apparatus according to claim 16, said sheet transport belt comprising one of a variable speed and constant speed sheet transport belt.

* * * * *